US008768219B2

(12) United States Patent
Gilmartin et al.

(10) Patent No.: US 8,768,219 B2
(45) Date of Patent: Jul. 1, 2014

(54) BIAS CHARGING OVERCOAT

(75) Inventors: Brian P. Gilmartin, Williamsville, NY (US); Liang-Bih Lin, Rochester, NY (US); Jeanne M. Koval, Marion, NY (US); Aaron M. Stuckey, Fairport, NY (US); Gary A. Batt, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 1258 days.

(21) Appl. No.: 12/622,682

(22) Filed: Nov. 20, 2009

(65) Prior Publication Data

US 2011/0123219 A1 May 26, 2011

(51) Int. Cl.
*G03G 15/02* (2006.01)

(52) U.S. Cl.
CPC ..... *G03G 15/0233* (2013.01); *G03G 15/0216* (2013.01)
USPC ..... 399/176

(58) Field of Classification Search
CPC ..... G03G 15/0233; G03G 15/02; G03G 15/0291; G03G 15/0258; G03G 15/0216
USPC ..... 399/115, 176
See application file for complete search history.

(56) References Cited

U.S. PATENT DOCUMENTS

| | | | | |
|---|---|---|---|---|
| 4,899,689 | A * | 2/1990 | Takeda et al. | 399/286 |
| 4,966,675 | A * | 10/1990 | Steininger | 204/290.07 |
| 5,017,965 | A | 5/1991 | Hashimoto et al. | |
| 5,068,063 | A | 11/1991 | Tremper, III | |
| 5,678,140 | A | 10/1997 | Fuei et al. | |
| 5,804,309 | A | 9/1998 | Itoh et al. | |
| 5,822,169 | A | 10/1998 | Yoshioka et al. | |
| 6,203,855 | B1 | 3/2001 | Tarnawskyj et al. | |
| 6,376,594 | B1 | 4/2002 | Sasagawa et al. | |
| 6,458,883 | B1 | 10/2002 | Takashima et al. | |
| 6,807,389 | B2 | 10/2004 | Facci et al. | |
| 6,889,023 | B2 | 5/2005 | Suda et al. | |
| 6,915,095 | B2 | 7/2005 | Longhenry et al. | |
| 6,962,746 | B2 | 11/2005 | Taniguchi et al. | |
| 2002/0086125 | A1 * | 7/2002 | Kakii et al. | 428/36.91 |
| 2003/0113650 | A1 | 6/2003 | Suwabe et al. | |
| 2004/0057749 | A1 | 3/2004 | Saito et al. | |
| 2006/0034636 | A1 * | 2/2006 | Kosuge et al. | 399/176 |
| 2007/0224404 | A1 | 9/2007 | Finley et al. | |
| 2007/0230975 | A1 | 10/2007 | Yamazaki et al. | |
| 2007/0271792 | A1 * | 11/2007 | Kagawa et al. | 29/895 |
| 2009/0180806 | A1 * | 7/2009 | Oshima et al. | 399/176 |
| 2011/0207872 | A1 | 8/2011 | Schinkel et al. | |
| 2013/0004205 | A1 | 1/2013 | Gilmartin et al. | |

FOREIGN PATENT DOCUMENTS

| | | | |
|---|---|---|---|
| EP | 0606907 | A1 | 7/1994 |
| JP | 2006163059 | A | 6/2006 |

OTHER PUBLICATIONS

U.S. Appl. No. 12/548,522, Office Action dated Apr. 26, 2012.
U.S. Appl. No. 12/622,684, Office Action dated Apr. 4, 2012.
U.S. Appl. No. 12/548,522, Office Action dated Oct. 20, 2011.
U.S. Appl. No. 12/622,684, filed Oct. 16, 2012, Final Office Action.

(Continued)

*Primary Examiner* — Walter L Lindsay, Jr.
*Assistant Examiner* — Frederick Wenderoth
(74) *Attorney, Agent, or Firm* — Hoffman Warnick LLC

(57) ABSTRACT

Provide herein is a description of a bias charging member that includes a conductive core, and an outer surface layer disposed on the conductive core. The outer surface layer includes carbon black and acrylonitrile-butadiene-styrene.

18 Claims, 2 Drawing Sheets

(56) References Cited

OTHER PUBLICATIONS

Wenderoth: U.S. Appl. No. 12/548,522, Office Action Nov. 26, 2012, 19pgs.

Wenderoth, U.S. Appl. No. 12/548,522, Notice of Allowance & Fees Due, 20090379-US-NP, Mar. 13, 2013, 9 pages.

U.S. Appl. No. 12/622,684, Office Action dated Jun. 14, 2013.

* cited by examiner

BIAS CHARGING OVERCOAT

TECHNICAL FIELD

The disclosure herein relates to overcoat layers, and more specifically, to an outer surface layer of carbon black and acrylonitrile butadiene-styrene for xerographic members such as bias charging members.

BACKGROUND

In a conventional charging step included in electrophotographic processes using an electrophotographic photosensitive member, in most cases a high voltage (DC voltage of about 5-8 KV) is applied to a metal wire to generate a corona, which is used for the charging. In this method, however, a corona discharge product such as ozone and $NO_x$ is generated along with the generation of the corona. Such a corona discharge product deteriorates the photosensitive member surface and may cause deterioration of image quality such as image blurring or fading or the presence of black streaks across the copy sheets. Further, ozone contamination may be harmful to humans if released in relatively relatively large quantities. In addition, a photosensitive member that contains an organic photoconductive material is susceptible to deterioration by the corona products.

Also, as the power source, the current directed toward the photosensitive member is only about 5 to 30% thereof. Most of the power flows to the shielding plate. Thus, the efficiency of the charging means is low.

For overcoming or minimizing such drawbacks, methods of charging have been developed using a direct charging member for charging the photosensitive member. For example, U.S. Pat. No. 5,017,965 to Hashimoto et al., uses a charging member having a surface layer which comprises a polyurethane resin. Another approach, European Patent Application 0 606 907 A1, uses a charging roller having an elastic layer comprising epichlorohydrin rubber, and a surface layer thereover comprising a fluorine containing bridged copolymer.

These and other known charging members are used for contact charging a charge-receiving member (photoconductive member) through steps of applying a voltage to the charging member and disposing the charging member being in contact with the charge-receiving member. Such bias charging members require a resistivity of the outer layer within a desired range. Specifically, materials with resistivities which are too low will cause shorting and/or unacceptably high current flow to the photoconductor. Materials with too high resistivities will require unacceptably high voltages. Other problems which can result if the resistivity is not within the required range include nonconformance at the contact nip, poor toner releasing properties and generation of contaminant during charging. These adverse affects can also result in bias charging members having non-uniform resistivity across the length of the contact member. It is usually the situation that most of the charge is associated at or near the center of the charge member. The charge seems to decrease at points farther away from the center of the charge member. Other problems include resistivity that is susceptible to changes in temperature, relative humidity, running time, and leaching out of contamination to photoconductors.

Due to its contact, the direct charging apparatus also causes more wear and tear to itself, imaging members and any other components with which it comes in contact. Failure modes in a bias charge roller (BCR) show up in prints such as dark streaks, and white and dark spots, which are associated with surface damages on BCR. These defects are usually derived from degradation or debris build-up on the BCR surface along the circumference, i.e. the process direction. The degradations can be scratches, abrasion, or pothole-like damages to the BCR surface. Another known deficiency is toner filming on the BCR surface that can also show up as print streaks. All these failures will reduce BCR life and therefore limit usage life.

SUMMARY

There is described a bias charging member that includes a conductive core, and an outer surface layer disposed on the conductive core. The outer surface layer includes carbon black and acrylonitrile-butadiene-styrene.

There is further described a method of refurbishing a bias charging member. The method includes obtaining a bias charging member having a conductive core and an outer surface. A dispersion of a carbon black and a polymer acrylonitrile-butadiene-styrene is coated on the outer surface. The coating is heated to form a conductive overcoat.

There is further described a bias charging member including a conductive core and an outer surface layer disposed on the conductive core. The outer surface layer includes carbon black and a polymer, wherein the outer surface layer has a surface resistivity of from about $1\times10^5$ to about $1\times10^{12}$ ohm/, a Young's modulus of from about 2000 to about 5000 Mpascals and a Poisson's ratio of from about 0.2 to about 0.5.

DETAILED DESCRIPTION

Figure 1:
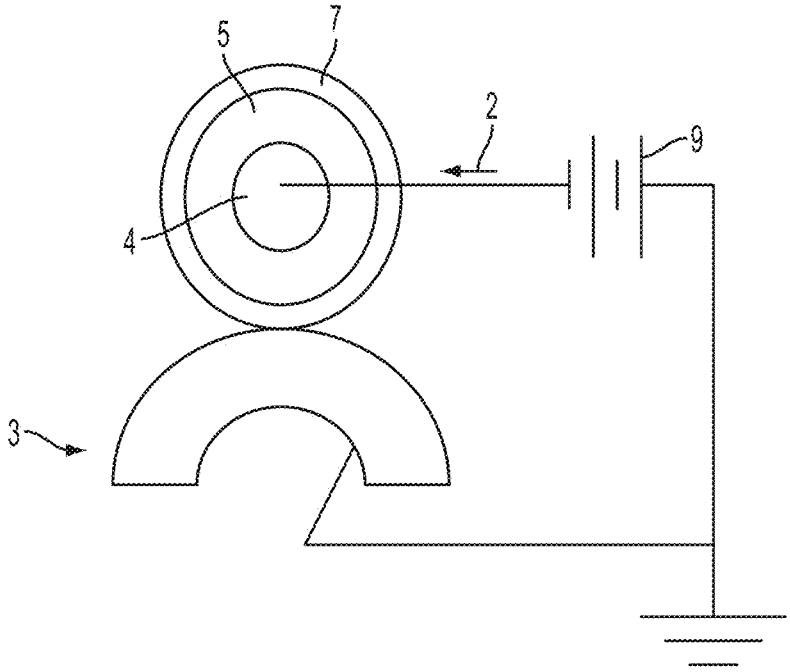
FIG. 1 demonstrates an illustrative bias charging roll (BCR) having an electrically conductive core and an outer surface layer provided thereon.

Referring to FIG. 1, there is shown an embodiment having a bias charging roller (BCR) 2 held in contact with an image carrier implemented as a photoconductive member 3. However, embodiments herein can be used for charging a dielectric receiver or other suitable member to be charged. The photoconductive member 3 may be a drum, a belt, a film, a drelt (a cross between a belt and a drum) or other known photoconductive member. While the BCR 2 is in rotation, a DC voltage and optional AC current is applied from a power source 9 to an electro-conductive core 4 of the BCR 2 to cause it to charge the photosensitive member 3. Shown in FIG. 1, the electro-conductive core 4 is surrounded by a base material 5. Although shown as one layer, it is possible to eliminate the base material 5 or have multiple layers of base material 5. These layers are referred to as base layers, intermediate layers or substrate layers. The base material 5 for the BCR 2 can be any elastic material with semiconductive dopant of suitable fillers discussed below. A conductive protective overcoat is provided on the base material 5 of the BCR 2 to form the outer surface layer 7. There may or may not be a filler in the substrate layer, intermediate layer, and outer layer.

The outer surface layer or protective overcoat layer 7 contains semiconductive carbon black doped in an acrylonitrile-butadiene-styrene (ABS) copolymer. The density of the carbon black was about 264 kg/m$^3$.

The bulk and surface conductivity of the outer surface layer 7 should be higher than that of the BCR 2 to prevent electrical drain on the BCR 2, but only slightly more conductive. Surface layers 7 with from about $1\times10^7$ ohm/ to about $1\times10^{12}$ ohm/, of from about $1\times10^2$ ohm/ to about $1\times10^8$ ohm/, or from about $1\times10^5$ ohm/ to about $1\times10^6$ ohm/ surface resistivity were found to be advantageous.

The electro-conductive core 4 serves as an electrode and a supporting member of the charging roll, and is composed of an electro-conductive material such as a metal or alloy of aluminum, copper alloy, stainless steel or the like; iron coated with chromium or nickel plating; an electro-conductive resin and the like. The diameter of the electro-conductive core is, for example, about 1 mm to about 20 cm, or from about 5 mm to about 2 cm.

The base material 5 can be isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber (EPDM), acrylonitrile-butadiene copolymer rubber (NBR), natural rubber, and blends thereof. Among these, polyurethane, silicone rubber, EPDM, epichlorohydrin-ethylene oxide copolymer rubber, epichlorohydrin-ethylene oxide-allyl glycidyl ether copolymer rubber, NBR, and blends thereof are preferably used.

An electro-conductive agent, an electronic electro-conductive agent or an ionic electro-conductive agent may be used in the base materials. Examples of the electronic electro-conductive agent include fine powder of: carbon black such as Ketjen Black and acetylene black; pyrolytic carbon, graphite; various kinds of electro-conductive metal or metal alloy such as aluminum, copper, nickel and stainless steel; various kinds of electro-conductive metal oxide such as tin oxide, indium oxide, titanium oxide, tin oxide-antimony oxide solid solution, and tin oxide-indium oxide solid solution; insulating materials having a surface treated by an electro-conductive process; and the like. Furthermore, examples of the ionic electro-conductive agent include perchlorates or chlorates of tetraethylammonium, lauryltrimethyl ammonium and the like; perchlorates or chlorates of alkali metal such as lithium and magnesium, and alkali earth metal; and the like. These electro-conductive agents may be used alone, or in combination of two or more kinds thereof.

Furthermore, the amount of addition to the base materials is not particularly limited. For example, the amount of electro-conductive agent to be added is from about 1 to about 30 parts by weight, or from about 5 to about 25 parts by weight with respect to 100 parts by weight of the rubber material. The amount of the ionic electro-conductive agent to be added is in the range of about 0.1 to about 5.0 parts by weight, or from about 0.5 to about 3.0 parts by weight with respect to 100 parts by weight of the rubber material. The layer thickness of the base material is from about 10 mm to about 20 cm, or from about 50 mm to about 3 cm.

The outer surface layer 7 is composed of ABS acrylonitrile-butadiene-styrene copolymer and a conductive agent such as carbon black. The carbon black loading is directly correlated to the surface resistivity of the material. The amount of the electro-conductive agent to be added is not particularly limited. For example, the amount of electro-conductive agent can be in the range of about 0.1 to about 40 by weight, or from about 4 to about 9 parts by weight, or in the range of about 6 to 7 parts by weight with respect to 100 parts by weight of the total weight of the coating. The layer thickness of the outer surface layer is from about 0.1 μm to about 500 μm, or from about 1 μm to about 50 μm.

The acrylonitrile-butadiene-styrene of the outer surface layer 7 can include from about 5 weight percent acrylonitrile to about 25 weight percent acrylonitrile, from about 10 weight percent butadiene to about 40 weight percent butadiene, and from about 50 weight percent styrene to about 90 weight percent styrene and all ranges therebetween. The bias charging member outer surface layer has a Young's modulus of from about 2000 to about 5000 Mpascals. The bias charging member outer surface layer includes a Poisson's ratio of from about 0.2 to about 0.5.

There may be present a conductive filler in any one of the substrate layers intermediate layers or protective overcoat layers. Conductive fillers include those listed previously as electroconductive agents and particles and carbon fillers such as carbon black, graphite, fluorinated carbon, and the like; conductive polymer fillers such as polyaniline, polypyrrole, polythiophene, polyacetylene and the like; metal fillers such as silver, copper, antimony and the like; metal oxide fillers such as titanium oxides, zinc oxides antimony tin oxides and the like.

There may be present non-conductive fillers in the substrate layers or intermediate layers.

The protective overcoat 7 also allows for refurbishing of the BCR 2. By applying a protective overcoat 7 to a BCR 2 having a damaged surface, either the base material 5 or the outer surface, a BCR can be used multiple times. When the outer surface of the BCR 2 becomes too damaged to provide acceptable prints, it is returned for refurbishing. Refurbishing involves applying a protective overcoat or outer surface layer 7 as described herein. After application of the surface layer, the BCR is typically heated to remove any residual solvent.

Since BCRs usually can last in machine for many thousand cycles, accelerated testing was performed with a print cartridge wear test fixture. The protocol for the testing involves initial screening (time=0), which involves resistance and charge uniformity measurements, and print test. The BCR was subjected to wear for 50,000 cycles in the wear fixture, followed by a screening under the same procedures as the time=0 screening. The same process continued, i.e. screening at successive 50 thousand intervals in the wear fixture, until significant print streaks appeared.

EXAMPLES 1 and 2

The overcoat dispersions were prepared by ball milling two samples of Blendex 200, an ABS copolymer available from Chemtura Corp., with Vulcan XC72 carbon black (Cabot) in THF. The ABS samples were milled over the course of 5 days with 12 and 14 weight percent carbon black based on total solids weight of the dispersion, which gave a surface resistivity of $10^{12}$ and $10^7$ Ω/□ respectively. Following filtration of the samples, each of the dispersions was coated on BCRs using a Tsukiage coater, providing 6 μm overcoats. The rollers were then dried in a convection oven at 135° C. for 15 min.

Figure 2:
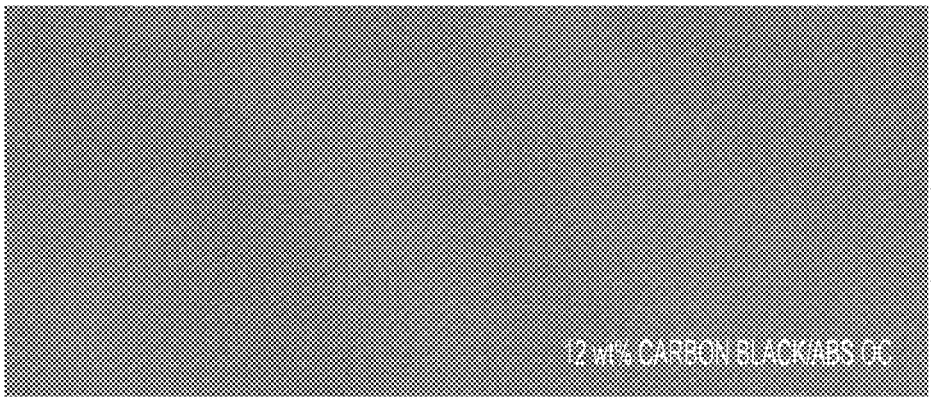
FIG. 2 shows a scanned image print output from a BCR having an outer surface layer in accordance with an aspect herein.
Figure 3:
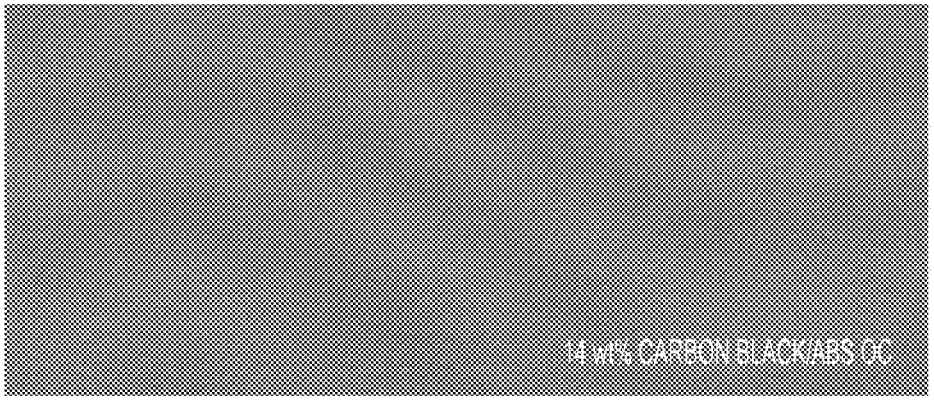
FIG. 3 shows a scanned image print output from a BCR having an outer surface layer in accordance with an aspect herein.

The print tests are shown in FIGS. 2 and 3. The protocol chosen to test the BCRs included screening at time=0 for resistance, charge uniformity and print testing. Following a 50,000 cycle test in a Hodaka wear rate fixture, the BCRs were then subjected to the same testing as that at time=0.

Charge uniformity measurements of the two BCRs with 12 and 14 wt % carbon black/ABS overcoats and regular BCRs with no overcoat at time equal zero and after 50,000 cycles were compared. The charge uniformity of overcoated BCRs was comparable to the standard BCR without any overcoats before and after the wear test, suggesting there is no internal electric build-up in the overcoat layers and no deterioration in the charging capability with the addition of the overcoat.

Start and running torques of the overcoated BCRs were comparable with standard BCR and the results are consistent with print and wear test, as no noticeable torque issues were detected.

Figure 4:
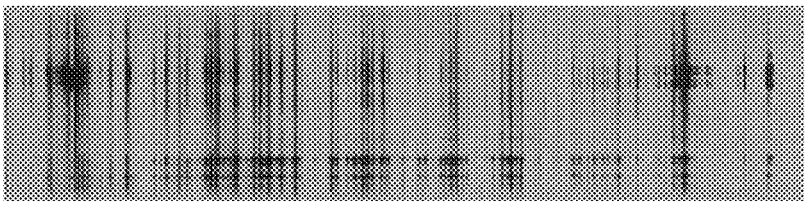
FIG. 4 shows a scanned image print output of a standard BCR.

Print testing of the BCRs with the ABS overcoats showed significant improvement over prints obtained from the BCR with no overcoat. FIGS. 2 and 3 shows print images with ABS/carbon black overcoated BCRs after 50,000 cycles. No print defects were observed from these BCRs after they were subjected to 50,000 cycles. In addition, it should be noted that there were no discernable differences between the prints with 12 wt % and 14 wt % carbon black. In contrast, FIG. 4 shows the print obtained from the control BCR with no overcoat, in which significant streaking is observed.

In summary, an overcoat for a BCR composed of ABS copolymer doped with carbon black significantly improves print quality compared to a BCR with no overcoat. The overcoated BCRs display excellent charge uniformity, which is comparable to a BCR with no overcoat. After subjecting the overcoated BCRs to 50,000 cycles, no black streaks are observed, which is in contrast to prints obtained from a BCR with no overcoat. In addition, it should be noted that no differences in print quality are observed between the 12 wt % ($10^{12}$ Ω/□ surface resistivity) and 14 wt % ($10^{7}$ Ω/□) carbon black loaded overcoats.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. A bias charging member comprising:

a) a conductive core, and b) an outer surface layer disposed on the conductive core, the outer surface layer comprising carbon black and acrylonitrile-butadiene-styrene, wherein the outer surface layer has a surface resistivity of from about $1\times10^{7}$ ohms/square to about $1\times10^{12}$ ohms/square.

2. The bias charging member in accordance with claim 1, wherein the carbon black comprises from about 0.1 to about 40 percent by weight based on the weight of total solids of the outer surface layer.

3. The bias charging member in accordance with claim 1, wherein the outer surface layer comprises a Young's modulus of from about 2000 to about 5000 Mpascals.

4. The bias charging member in accordance with claim 1, wherein the outer surface layer comprises a Poisson's ratio of from about 0.2 to about 0.5.

5. The bias charging member in accordance with claim 1, wherein the acrylonitrile-butadiene-styrene comprises from about 5 weight percent acrylonitrile to about 25 weight percent acrylonitrile, from about 10 weight percent butadiene to about 40 weight percent butadiene, and from about 50 weight percent styrene to about 90 weight percent styrene.

6. The bias charging member in accordance with claim 1, further comprising a base material disposed between the conductive core and the outer surface layer.

7. The bias charging member in accordance with claim 6, wherein the base material is selected from the group consisting of isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber.

8. A method of refurbishing a bias charging member comprising:

obtaining a bias charging member having a conductive core and an outer surface;

coating a dispersion of a carbon black and polymer acrylonitrile-butadiene-styrene on the outer surface; and heating the coating to form a conductive overcoat, wherein the conductive overcoat has a surface resistivity of from about $1\times10^{5}$ ohms/square to about $1\times10^{12}$ ohms/square.

9. The method of claim 8, wherein the acrylonitrile-butadiene-styrene comprises from about 5 weight percent acrylonitrile to about 25 weight percent acrylonitrile, from about 10 weight percent butadiene to about 40 weight percent butadiene, and from about 50 weight percent styrene to about 90 weight percent styrene.

10. The method of claim 8, wherein the carbon black comprises an amount from about 0.1 to about 40 percent by weight based on the weight of total solids of the conductive overcoat.

11. The method of claim 8, wherein the bias charging member comprises a base material disposed over the conductive core.

12. The method of claim 11, wherein the base material is selected from the group consisting of isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber.

13. A bias charging member comprising:

a) a conductive core, and b) an outer surface layer provided on the conductive core and comprising a carbon black and acrylonitrile-butadiene-styrene, wherein the outer surface layer has a surface resistivity of from about $1\times10^{5}$ ohm/square to about $1\times10^{12}$ ohms/square, a Youngs modulus of from about 2000 to about 5000 Mpascals and a Poisson's ratio of from about 0.2 to about 0.5.

14. The bias charging member in accordance with claim 13, wherein the acrylonitrile-butadiene-styrene comprises from about 5 weight percent acrylonitrile to about 25 weight percent acrylonitrile, from about 10 weight percent butadiene to about 40 weight percent butadiene, and from about 50 weight percent styrene to about 90 weight percent styrene.

15. The bias charging member in accordance with claim 13, further comprising a base material disposed between the outer core and the outer surface layer.

16. The bias charging member in accordance with claim 15, wherein the base material is selected from the group consisting of isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber.

17. The bias charging member in accordance with claim 13, wherein the outer surface layer comprises a thickness of from about 0.1 μm to about 500 μm.

18. The bias charging member in accordance with claim 13, wherein the carbon black comprises from about 0.1 to about 40 percent by weight based on a weight of total solids of the outer surface layer.

* * * * *